US010016004B1

(12) United States Patent
Frederick

(10) Patent No.: US 10,016,004 B1
(45) Date of Patent: Jul. 10, 2018

(54) CLOTHING CLASP

(71) Applicant: Venus Fashion, Inc., Jacksonville, FL (US)

(72) Inventor: Jodi Frederick, Jacksonville, FL (US)

( * ) Notice: Subject to any disclaimer, the term of this patent is extended or adjusted under 35 U.S.C. 154(b) by 0 days.

(21) Appl. No.: 15/452,151

(22) Filed: Mar. 7, 2017

Related U.S. Application Data

(63) Continuation-in-part of application No. 15/438,212, filed on Feb. 21, 2017, now abandoned.

(51) Int. Cl.
*A41F 1/00* (2006.01)
*A41F 15/00* (2006.01)
*A44B 11/04* (2006.01)

(52) U.S. Cl.
CPC ..... *A41F 15/002* (2013.01); *A44B 11/04* (2013.01); *Y10T 24/44034* (2015.01)

(58) Field of Classification Search
CPC . A41F 15/002; A41F 1/00; A44C 1/00; Y10T 24/4093; Y10T 24/3698; Y10T 24/1362; Y10T 24/44017; Y10T 24/4056; Y10T 24/4012; Y10T 24/4095; Y10T 24/4098; Y10T 24/44034; A44B 11/001; A44B 11/04; A44B 1/18; A44B 99/00
USPC ..... 132/273
See application file for complete search history.

(56) References Cited

U.S. PATENT DOCUMENTS 567,195 A * 9/1896 Parramore ..... A41F 11/02 24/465
1,129,361 A 2/1915 Perry
1,399,730 A * 12/1921 Abe ..... A41F 19/005 24/114.12
1,589,158 A * 6/1926 Hedison ..... A41B 11/001 2/239
3,382,549 A * 5/1968 Price ..... A41F 1/00 24/487
4,175,305 A * 11/1979 Gillis ..... E04H 15/32 135/119
4,308,647 A * 1/1982 Gillis ..... A44B 99/00 135/120.1
4,985,968 A * 1/1991 Hooper ..... A44C 3/001 24/3.13
5,511,289 A * 4/1996 Melia ..... A44B 6/00 24/459
5,557,830 A * 9/1996 Davis ..... A44B 99/00 24/113 MP
5,610,877 A * 3/1997 Adams ..... G04B 37/1433 368/10
5,655,271 A * 8/1997 Maxwell-Trumble . A44C 3/001 24/113 MP
5,729,875 A 3/1998 Margulis
5,940,942 A * 8/1999 Fong ..... A44B 1/34 24/108

(Continued)

*Primary Examiner* — Robert John Sandy
*Assistant Examiner* — Michael S Lee
(74) *Attorney, Agent, or Firm* — Dykema Gossett PLLC

(57) ABSTRACT

A clothing clasp for shortening the length of a strap of a sleeveless garment includes a frame member providing an opening therethrough and a cooperating insert member having a raised area that can fit in the opening when positioned beneath the frame member. A portion of the strap can be pushed downwardly through the opening to provide a loop, and the insert member can be positioned within the loop so that its raised area will extend upwardly in the opening and remain there with tightening of the strap and reduction of the loop.

9 Claims, 6 Drawing Sheets

(56) References Cited

U.S. PATENT DOCUMENTS

| | | | | |
|---|---|---|---|---|
| 6,718,600 | B1 * | 4/2004 | Gillis | E04H 15/64 135/119 |
| 8,347,416 | B1 * | 1/2013 | Query | A41F 1/00 2/244 |
| 8,850,665 | B2 | 10/2014 | Watrach | |
| 9,345,433 | B1 * | 5/2016 | Shinozuka | A61B 5/1115 |
| 9,568,144 | B2 * | 2/2017 | Pernu | F16M 11/041 |
| 2010/0251459 | A1 * | 10/2010 | Schlesinger | A41F 17/02 2/232 |
| 2014/0137314 | A1 | 5/2014 | Needham | |
| 2014/0250640 | A1 | 9/2014 | Crooks | |

* cited by examiner

CLOTHING CLASP

CROSS-REFERENCE TO RELATED APPLICATION

This application is a continuation-in-part of application Ser. No. 15/438,212, filed Feb. 21, 2017, the contents of which is incorporated herein by reference and the priority of which is claimed.

BACKGROUND OF THE INVENTION

Field of the Invention

The present invention relates to clothing, in particular to sleeveless tops, and to devices which can be attached to such clothing for adjustment purposes.

The Prior Art

Garments for men and women involve a multitude of width and lengths and rarely will correctly fit a potential user in all ways. Adjustments will often be desirable. Permanent alterations may require professional expertise and be expensive, whereas temporary adjustments can be unsightly and therefore unsatisfactory.

In especially women's clothing one type of garment that can present a sizing problem is a sleeveless top, wherein the arm opening has been constructed to be too large, and thus is unsightly to wear. Fixing this problem, i.e., reducing the size of the arm opening, can be difficult for the ordinary user.

The object of the present invention is to provide clothing device which can be used on a sleeveless top to temporarily shorten the strap which extends over the wearer's shoulder and thereby reduce the size of the associated arm opening.

SUMMARY OF THE INVENTION

According to the invention a clothing clasp can be used on the strap of a sleeveless top to temporarily shorten the length of the strap and thereby reduce the size of the associated arm hole. This clothing strap can include a generally rectangular frame member and a generally rectangular insert member, the frame member defining a generally rectangular opening therethrough and the insert member can include a generally rectangular raised area in a top surface thereof, the raised area fitting within the opening in the frame member after a portion of a strap has been looped through the opening in the frame member and the base member has been inserted into the loop and moved upwardly so that its raised area extends into the opening in the frame member, the loop of the strap will become fixed beneath the frame member (thus shortened in length), and the arm hole of the garment will be reduced in size.

Further features and advantages of the invention will become apparent from the following discussion and the attached drawings.

DETAILED DESCRIPTION OF THE INVENTION

Figure 1A:
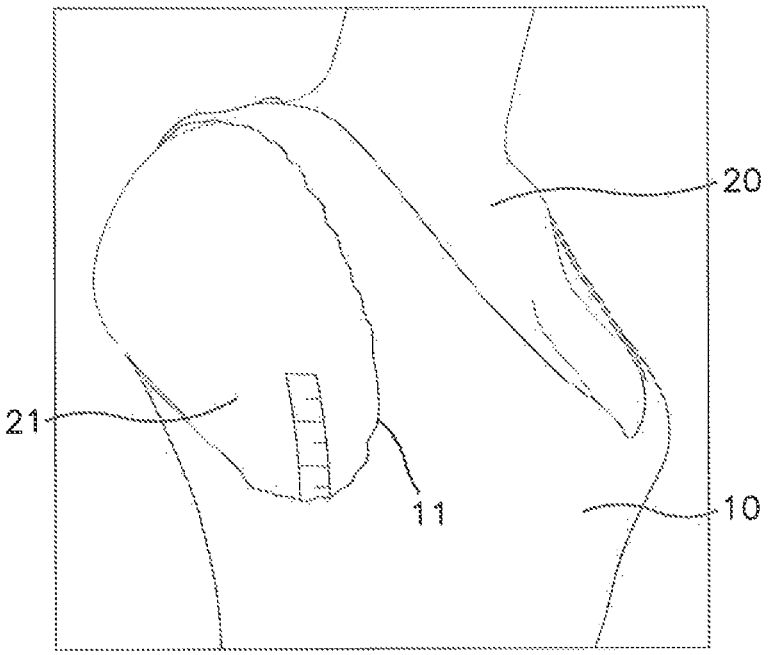
FIG. 1A depicts a sleeveless garment on a female manikin, representing a wearer, and wherein the opening provided by the garment for the arm of the manikin is undesirably large.

As illustrated in FIG. 1A, which shows a sleeveless garment 10 on a female manikin 20, depending on the design characteristics of the sleeveless garment (such as a tank top), the openings 11 for the arms of a wearer may be too large and may expose an armpit area 21 that is undesirably large when the wearer raises his or her arms. To avoid the need to reconstruct the garment, the clothing clasp of the present invention can be used to overcome this problem.

Figure 1B:
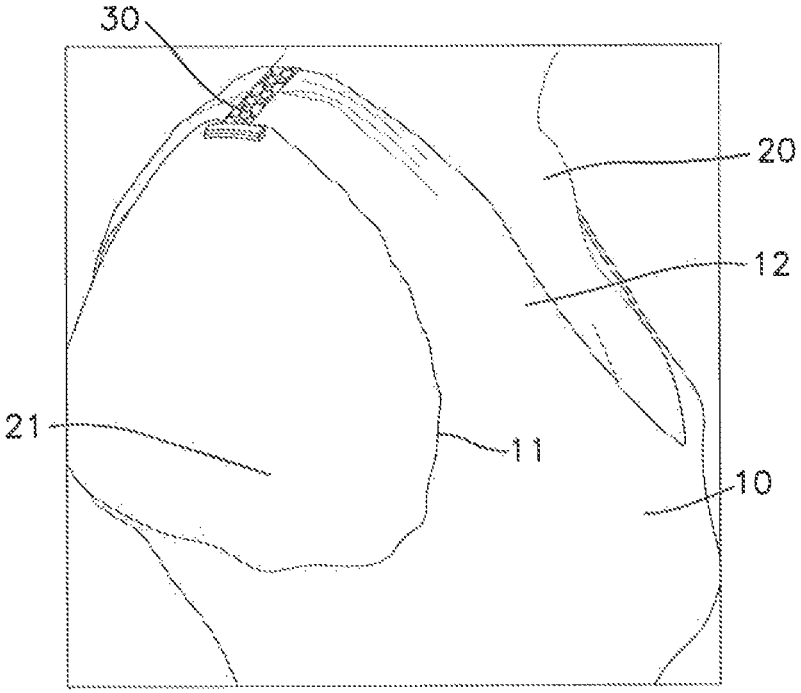
FIG. 1B depicts the same sleeveless garment on the female manikin of FIG. 1A, but wherein the clothing clasp of the present invention has been attached to the adjacent shoulder strap of the garment to shorten the length of the shoulder strap and thereby lift the adjacent side of the garment and the opening provided for the manikin's arm.

FIG. 1B shows the garment and manikin of FIG. 1A with the clothing clasp 30 of the invention installed in the shoulder strap 12 of the garment, thereby shortening its length and lifting the adjacent side of the garment and its arm opening, and consequently reducing the provided arm opening.

A first embodiment of clothing clasp 30 according to the invention is shown in FIGS. 2A-2D. It includes an elongated frame member 40 and an elongated insert member 50. The frame member 40 includes end parts 41, 42 and side parts 43, 44, which define a centrally-positioned, generally rectangular opening 45 (see FIG. 2C). As seen FIGS. 2B, 2C and 2D, the frame member is curved in its lateral dimension.

Figure 2A:
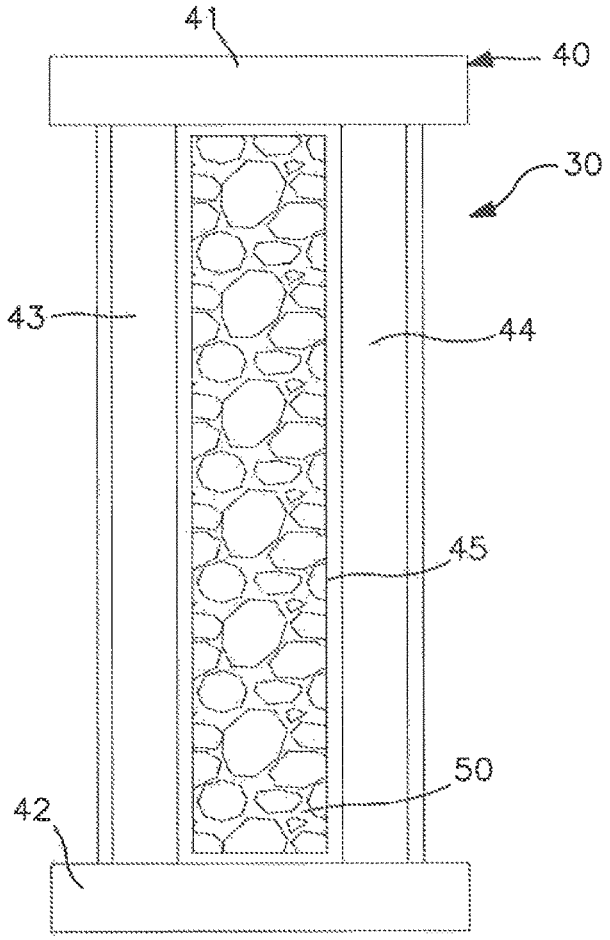
FIG. 2A is a top plan view of a first embodiment of a clothing clasp according to the present invention.
Figure 2B:
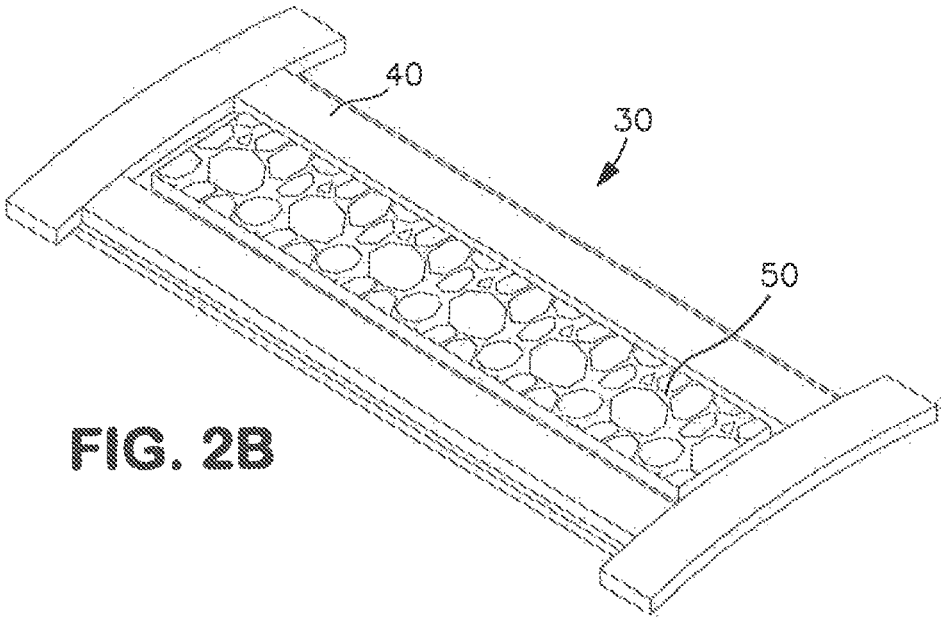
FIG. 2B is a perspective view of clothing clasp shown in FIG. 2A.
Figure 2C:
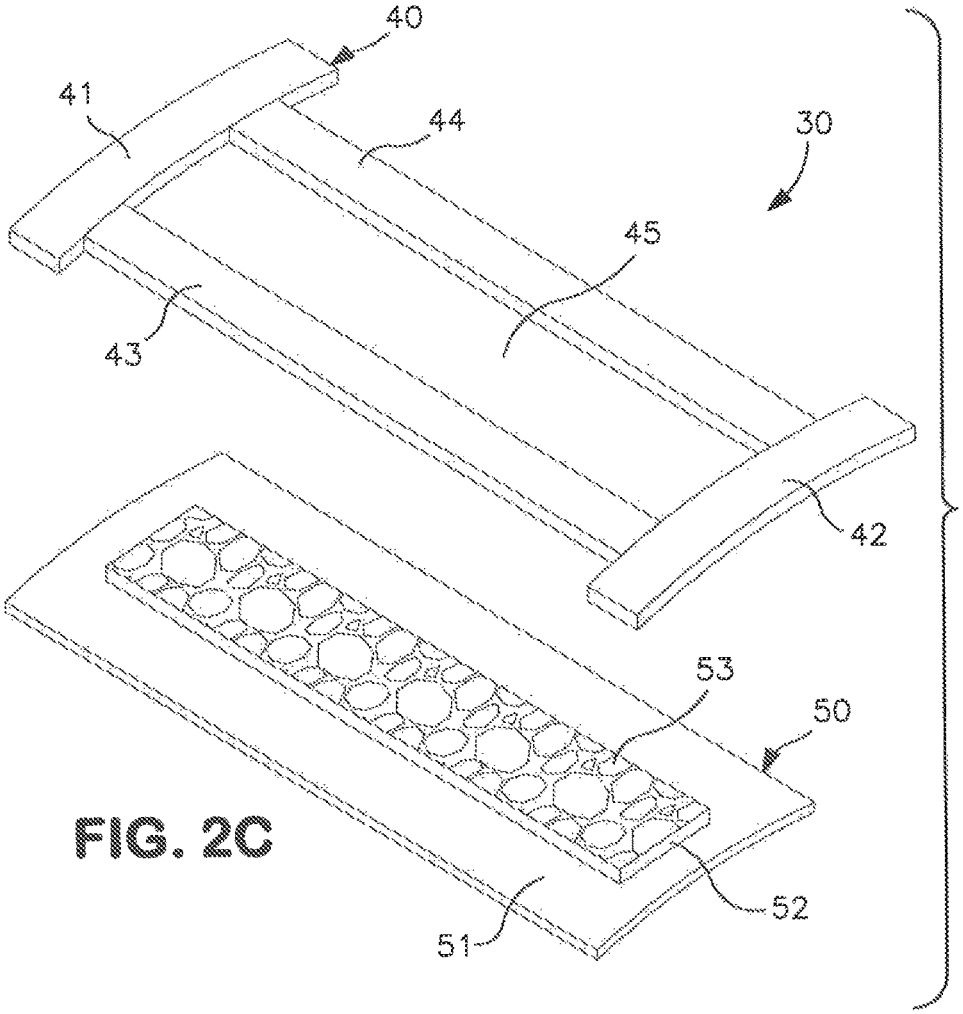
FIG. 2C is an exploded view of the clothing clasp shown in FIG. 2B, the insert member being depicted beneath the frame member thereof.
Figure 2D:
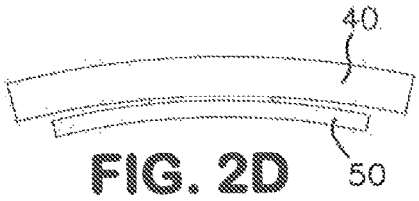
FIG. 2D is an elevational end view of the clothing clasp shown in FIG. 2A.

The elongated insert member 50 includes a laterally curved base part 51 and a centrally-positioned, generally rectangular raised area 52 projecting from an upper face of the base part. The raised area 52 is dimensioned to fit within the generally rectangular opening 45 in the frame member 40. It can have an upper surface which displays a decorative pattern, such a hammered pattern 53. The lateral curvature of the base part 51 corresponds to the lateral curvature of the frame member 40, as seen in FIG. 2D. The frame member 40 and the insert member 50 can be made of plastic or metal.

Figure 3A:
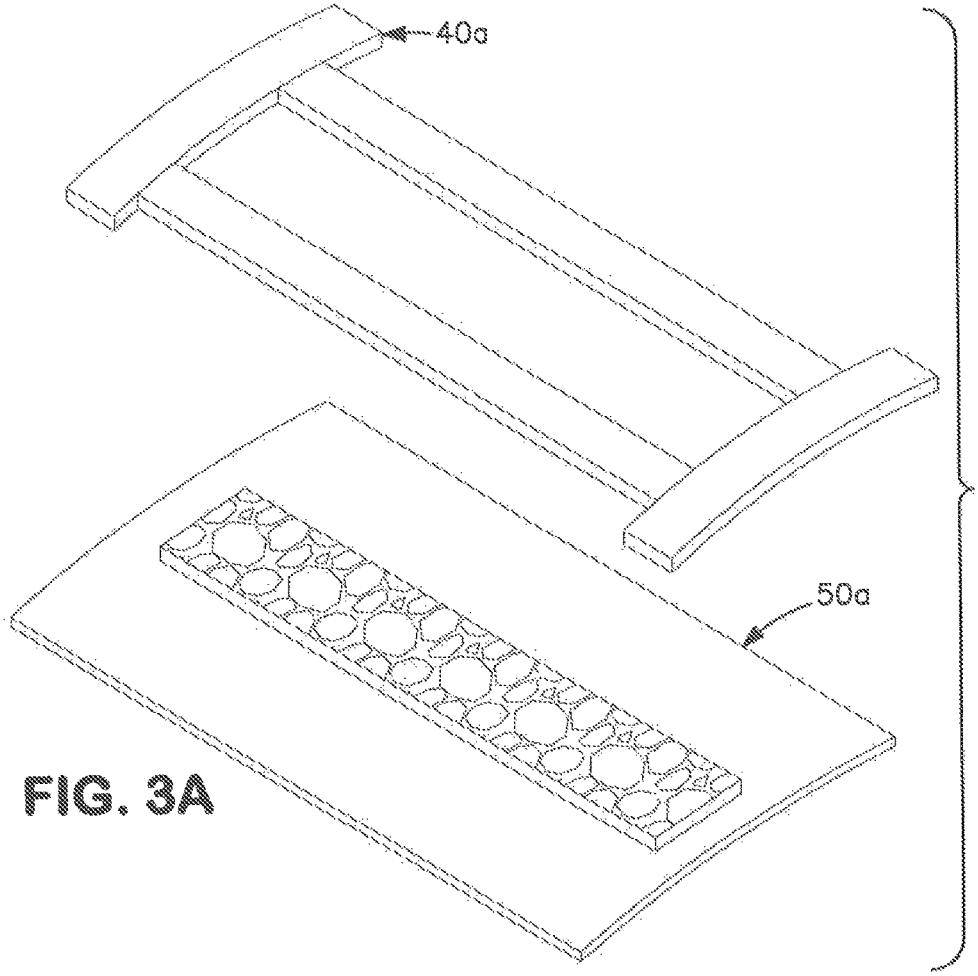
FIG. 3A is an exploded view of second embodiment of a clothing clasp according to the present invention.
Figure 3B:
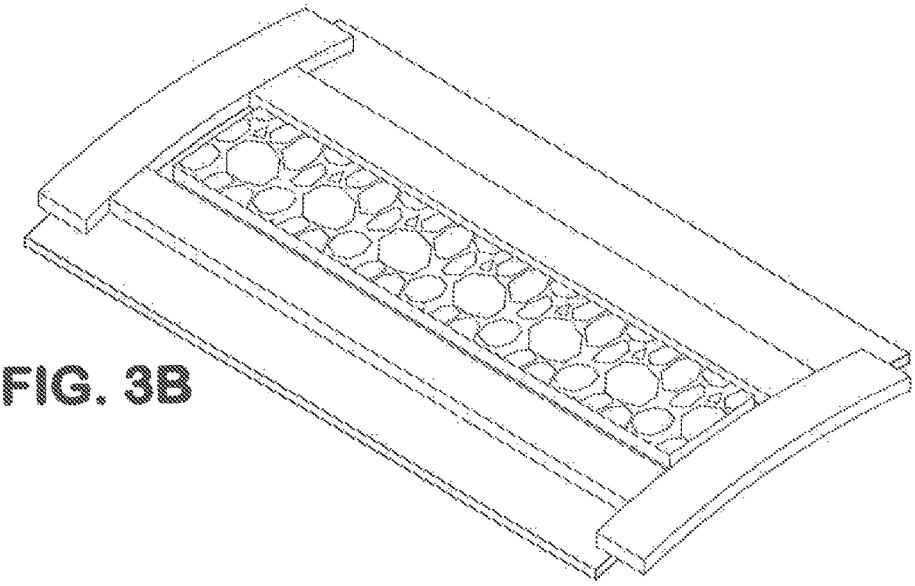
FIG. 3B is a perspective view of the second embodiment of clothing clasp.

FIGS. 3A and 3B show exploded and perspective views of a second embodiment of a clothing clasp according to the invention, the frame member 40*a* and the insert member 50*a* being wider than the corresponding members of FIGS. 2A-2D.

Figure 4:
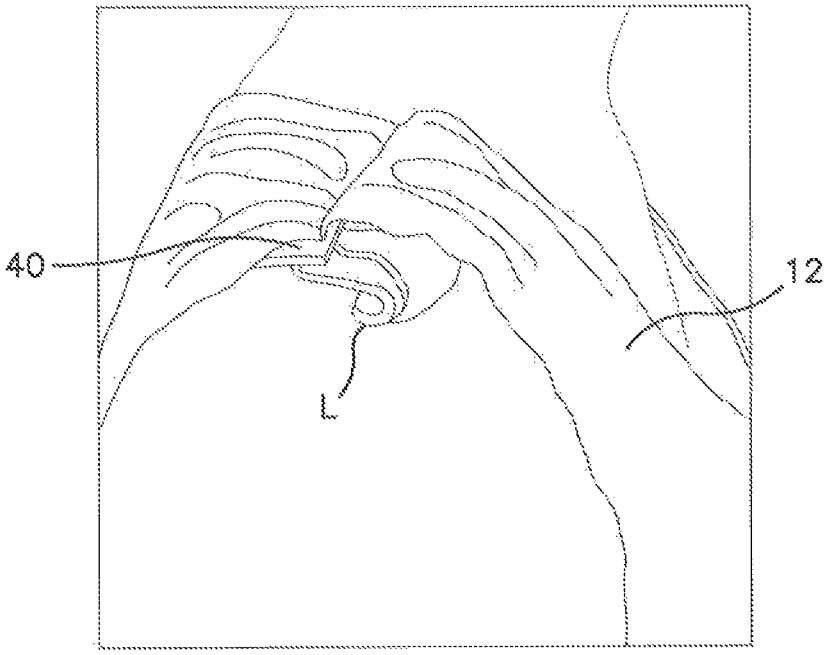
FIG. 4 depicts a looping of the material of the garment shoulder strap through the opening in the frame member of the FIG. 2A-2C embodiment during the course of attaching the clothing clasp to the shoulder strap.
Figure 5:
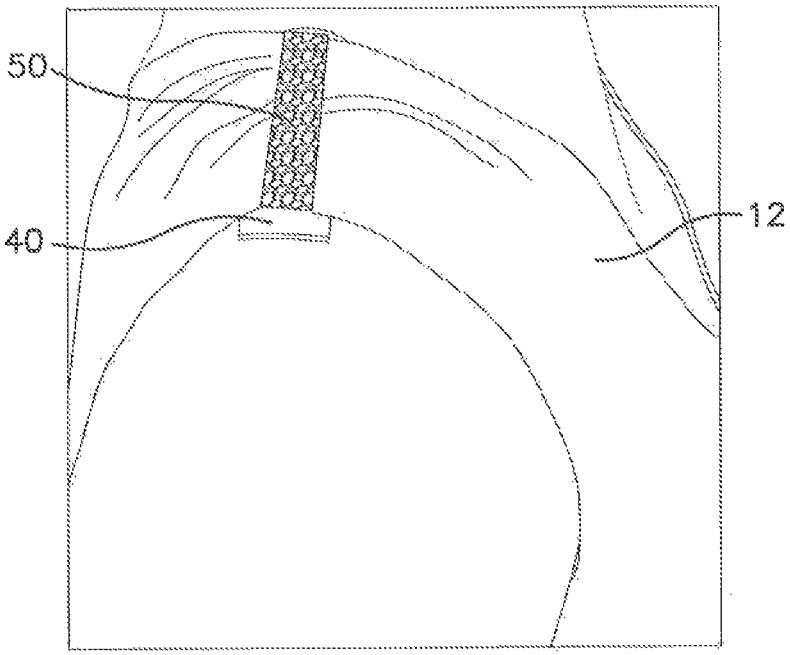
FIG. 5 depicts the shoulder strap within the clothing clasp in a fully attached state.
Figure 6:
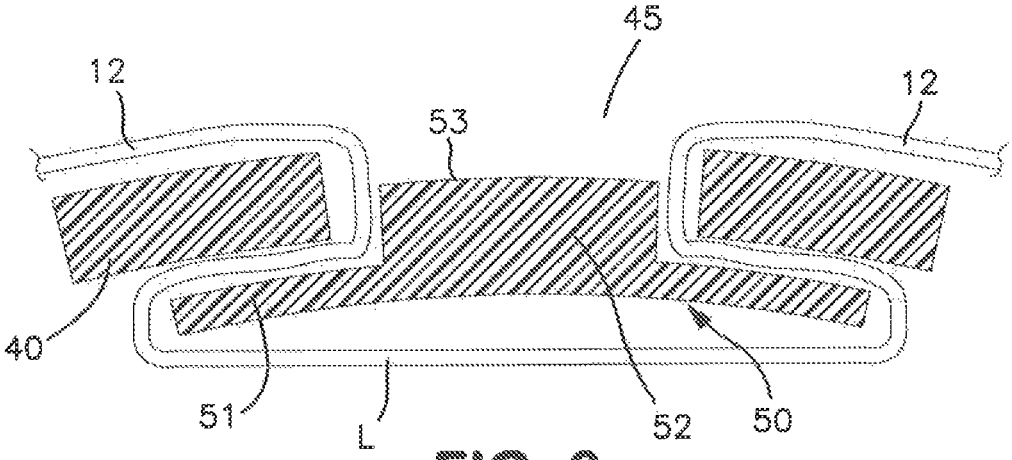
FIG. 6 shows a cross-section through the clothing clasp and the strap of FIG. 5 and illustrates the support of the insert member against the frame member by extending and tightening of the strap loop beneath the insert member.

To utilize the inventive clothing clasp, frame member 40 is positioned beneath the strap 12 of a sleeveless garment 10, and the material of the strap is pushed downwardly through the opening 45 in the frame member 40 to provide a loop L (see FIG. 4). Thereafter, the insert member 50 (with raised area 52 projecting upwardly) is slid lengthwise within the loop and beneath the frame member so that the raised area 52 is aligned with the opening 45, and the material of the strap is pulled tight so that the insert member is pushed upwardly, the raised area of the insert member being exposed (see FIGS. 1B and 5). The length of material of the strap that extends into the opening 45, around the insert member 50, and out of the opening 45, will shorten the strap and lift the adjacent side of the garment. Of course, similar clothing straps will likely be employed on both the left and right strap of a sleeveless garment. The frame and insert members can be square in configuration as well as elongated.

Although embodiments of the inventive clothing strap have been described, variations therein can be made and still fall within the scope of the attached claims.

I claim:

1. A combination of a garment having a strap and a clothing clasp for shortening a length of the strap, said clothing clasp comprising:

a frame member defining a generally rectangular opening therein, and an insert member having a centrally-positioned, generally rectangular raised area, said raised area of said insert member being extendable into the opening in the frame member when the frame member and the insert member are placed together so as to fixedly position a loop of the garment strap when extending through the generally rectangular opening and around the insert member.

2. The combination according to claim 1, wherein said frame member is curved from side to side.

3. The combination according to claim 2, wherein said insert member is curved from side to side.

4. The combination according to claim 3, wherein curvatures of the frame member and the insert member are identical.

5. The combination according to claim 1, wherein the raised area of the insert member provides a top surface which is decorated.

6. The combination according to claim 1, wherein said frame member and said insert member are made of plastic.

7. The combination according to claim 1, wherein said frame member and said insert member are both generally rectangular.

8. A method of shortening a length of a shoulder strap of a garment comprising the steps of:

(a) providing a clothing clasp which comprises a frame member defining a generally rectangular opening therein, and an insert member having a centrally-positioned, generally rectangular raised area, said raised area of said insert member being extendable into the opening in the frame member when the frame member and the insert member are placed together so as to fixedly position a loop of the garment strap when extending through the generally rectangular opening and around the insert member, (b) placing the frame member adjacent the strap and extending a loop of the strap through the opening in the frame member, (c) sliding the insert member into the loop to be positioned within the loop and adjacent the frame member, and (d) tightening the strap so that the loop becomes taut and moves the insert member toward the frame member so that the raised area thereof extends into the opening in the frame member.

9. The method according to claim 8, wherein in step (c) the insert member is slid lengthwise into the loop.

* * * * *